United States Patent [19]

Lewis

[11] Patent Number: 4,523,905

[45] Date of Patent: Jun. 18, 1985

[54] BURNER FOR GASEOUS FUELS

[75] Inventor: David Lewis, Birmingham, England

[73] Assignee: Nu-Way Energy Limited, England

[21] Appl. No.: 516,702

[22] Filed: Jul. 21, 1983

[51] Int. Cl.[3] ..... F23D 15/00

[52] U.S. Cl. ..... 431/351; 431/350; 432/222

[58] Field of Search ..... 432/222; 431/351, 350

[56] References Cited

U.S. PATENT DOCUMENTS 3,592,578 7/1971 Weatherston ..... 431/351

3,630,499 12/1971 Kramer ..... 432/222

FOREIGN PATENT DOCUMENTS 2105836 3/1983 United Kingdom ..... 431/351

*Primary Examiner*—Carroll B. Dority, Jr.

*Attorney, Agent, or Firm*—Andrus, Sceales, Starke & Sawall

[57] ABSTRACT

A burner for gaseous fuels has a combustion zone of elongate cross section which is defined between divergent flame-confining walls. Each wall comprises a plurality of wall elements which are arranged edge to edge, the adjacent edges being relatively movable and mounted so as to prevent significant gas flow therebetween, the wall elements being rigidly secured to the remainder of the burner only at locations which are upstream of the combustion zone.

3 Claims, 3 Drawing Figures

BURNER FOR GASEOUS FUELS

This invention relates to burners for fuel gas, and in particular to fuel-heating gas burners.

It is known, for example from U.S. Pat. No. 3,592,578 to provide a gas burner which comprises a plurality of elongate burner bodies which are secured end-to-end, and which are provided with flame confining wall elements which are rigidly secured end-to-end, to define an elongate combustion zone downstream of ports through which fuel gas emerges from the burner bodies. The flame-confining walls, being adjacent the combustion zone, are subjected to high temperatures and thus undergo considerable thermal expansion. The burner bodies, being upstream of the combustion zone and surrounded by an air flow to the combustion zone, experience much less thermal expansion, with the result that the flame-confining walls tend to buckle in use.

It is an object of the present invention to provide a gas burner of the type indicated above in which the flame confining walls are less subject to buckling.

According to the invention, a burner for gaseous fuel comprises a burner body for delivering a fuel gas to a combustion zone which is, in part, defined between two flame-confining walls on respective opposite sides of said zone, the cross-section of said combustion zone, transversely of the direction of gas flow therethrough, being elongate, each said wall being divided in the elongate direction thereof into a plurality of wall elements whose adjacent edges are free to move relatively so as to permit thermal expansion of said elements in said elongate direction, and means for mounting said elements to prevent a significant gas flow between said adjacent edges.

In a preferred embodiment, said wall elements are rigidly secured to said burner body only at locations on said elements which are upstream of said combustion zone.

An embodiment of the invention will now be described by way of example only and with reference to the accompanying drawings in which.

Figure 1:
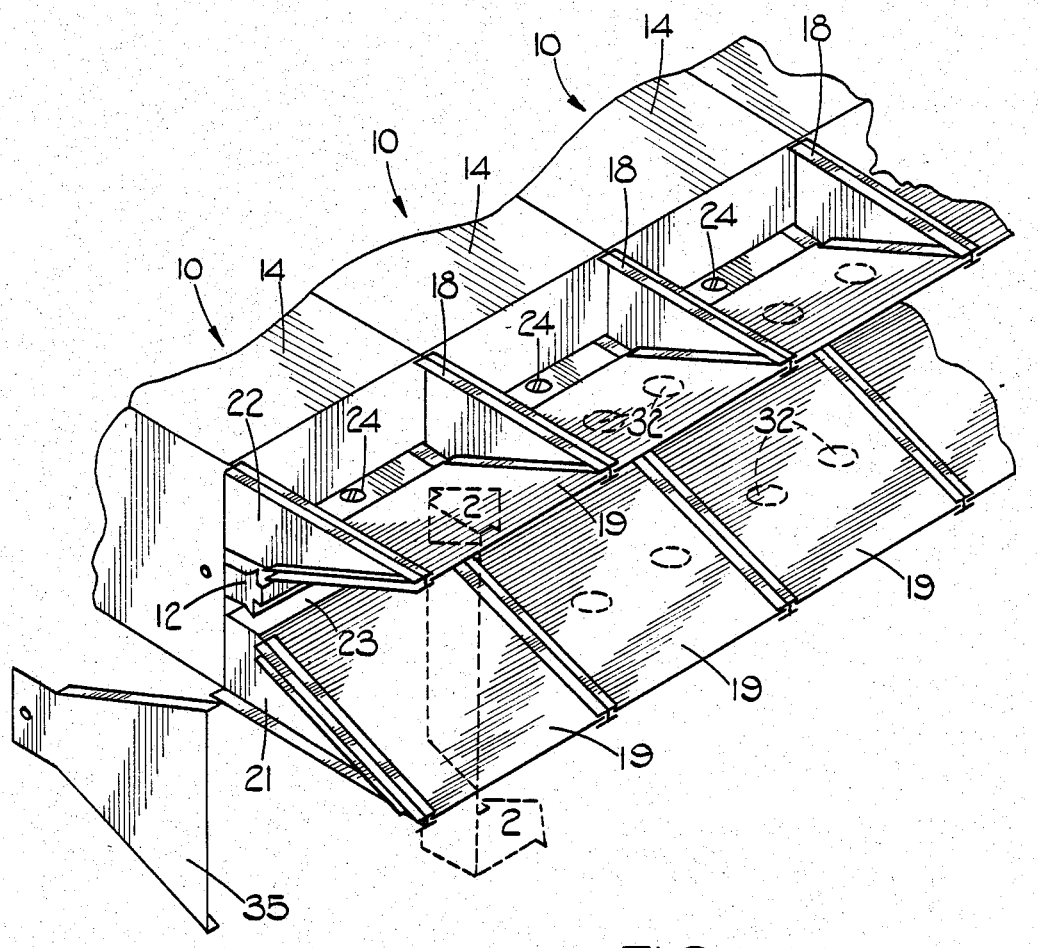
FIG. 1 is a diagrammatic and pictorial view of a part of a burner according to the invention.
Figure 2:
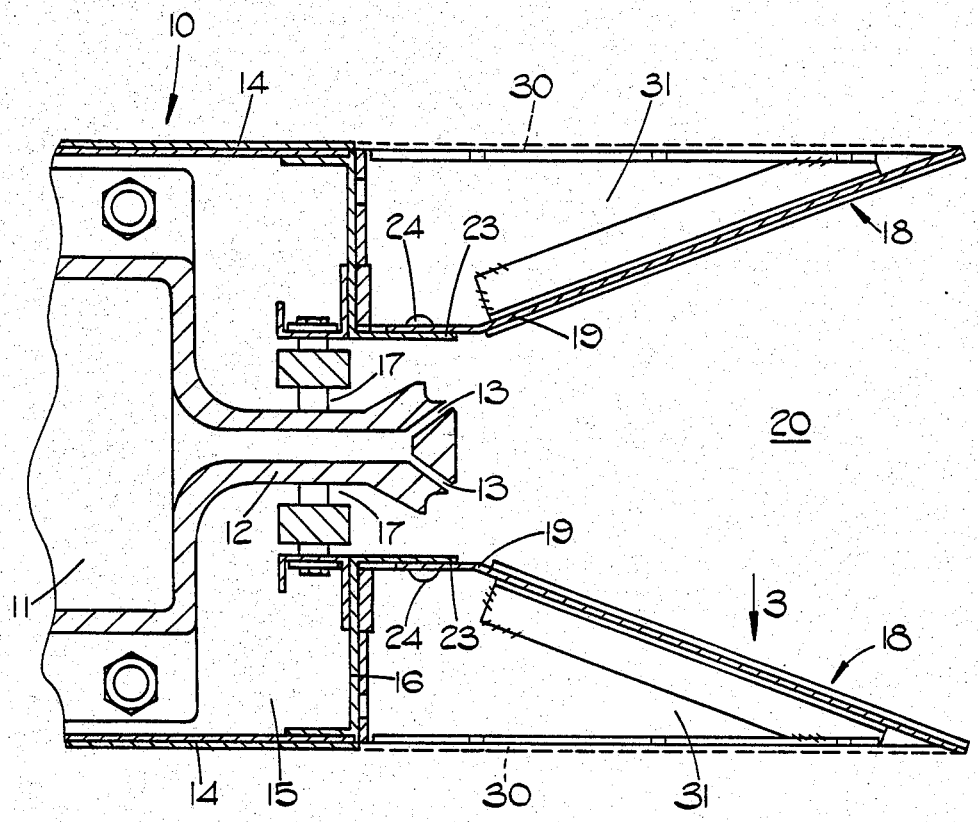
FIG. 2 is a section on the plane 2—2 in FIG. 1.
Figure 3:
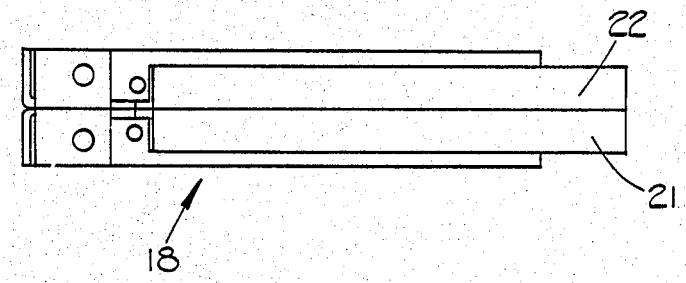
FIG. 3 is a view on arrow 3 in FIG. 2 of a support bracket.

As shown in FIG. 1, a plurality of burner body sections 10 are secured side-by-side. Each of the sections 10 includes a cast iron gas supply manifold 11 (FIG. 2) which terminates in a gas outlet passage 12 and gas ports 13. The body sections 10 also include a casing 14 which surrounds the manifold 11 and defines an air supply passage 15. The casing 14 has a front wall 16 through which the gas outlet passage 12 projects, so as to define air outlet ports 17 on either side of the passage 12. As shown in FIG. 2, the gas outlet passage 12 projects substantially downstream of the front wall 16.

Secured to the front walls 16 of the bodies 10 are a plurality of brackets 18 which support flame confining wall elements 19. The wall elements 19 diverge in a direction downstream of the end of the gas supply passage 12 and define a combustion zone 20 for a mixture of the gas and air issuing from the respective ports 13, 17.

The brackets 18 are provided by two bracket elements 21, 22 which are of opposite hand and are arranged back-to-back. Each bracket element 21, 22 is provided with a slot in which an edge of a wall element 19 is slidable, the overlap between the edges of the wall elements 19 and the opposite sides of the bracket slots being such as effectively to prevent passage of gas between the combustion zone 20 between adjacent edges of the elements 19. The dimensions of the wall elements 19 between the brackets 18 are such as to permit thermal expansion of the elements 19, transversely of the direction of gas flow through the zone 20, without distortion. Additionally, end cover plates, one of which is indicated at 35 in FIG. 1 are provided with flanges which can be engaged in outwardly facing slots in brackets 18 at outer ends of the burner. The cover plates 35 are secured to the burner body 10 only at locations which are upstream of the combustion zone 20, and are free to move in the slots of the brackets 18 in response to thermal expansion, and are therefore less subject to buckling.

As shown in FIG. 2, flanges 23 extend downstream from the front walls 16, on either side of the air outlet ports 17. The inner ends of the wall elements 19 are rigidly fixed to the flanges 23 by screws 24. These fixings are adjacent the airstream from the ports 17 and are upstream of the gas outlet ports 13. The fixings provided by the screws 24 are thus not subjected to the temperature rise encountered by the parts of the wall elements 19 adjacent the combustion zone 20.

Even if a large number of burner bodies 10 and wall elements 19 are connected side-by-side; in the manner shown in FIG. 1, to provide a combustion zone of greatly elongated cross-section, the freedom for expansion of the separate wall elements 19 will prevent buckling of the flame confining walls.

The arrangement shown in FIG. 2 is for a nozzle mixing burner, in which fuel gas and air are mixed adjacent the gas outlets 13. In alternative arrangements a fuel gas may be supplied to the manifold 11 and primary combustion air supplied through smaller air outlets adjacent the gas passage 12. In such an embodiment cover plates, as indicated at 30 are secured across the outer faces of the brackets 18 to define chambers 31 to which secondary combustion air is admitted through openings in the walls 16. This secondary combustion air flow to the combustion zone 20 through apertures indicated at 32 in FIG. 1.

In further alternative arrangements a gas and air mixture is supplied through the manifold 11. In such arrangements additional air may be supplied through the ports 17 and the apertures 32. In yet other embodiments these last air supplies may be dispensed with.

I claim:

1. A burner for gaseous fuels, comprising a burner body for delivering a fuel gas to a combustion zone which is, in part, defined between two flame-confining walls on respective opposite sides of said zone, the cross-section of said combustion zone, transversely of the direction of gas flow therethrough, being elongate, each said wall being divided in the elongate direction thereof into a plurality of separate wall elements whose adjacent edges are free to move relatively so as to permit thermal expansion of said elements in said elongate direction, and a plurality of brackets supporting said elements, each said bracket being secured to said body and extending therefrom in said direction of gas flow, each said bracket including a pair of slots on respective opposite sides thereof, said adjacent edges of said elements being slidably received in the respective slots so as to prevent a significant gasflow between said adjacent edges, said wall elements being rigidly secured to said burner body only at locations on said elements which are upstream of said combustion zone.

2. A burner as claimed in claim 1 in which said burner body comprises a plurality of body sections connected end to end in said elongate direction.

3. A burner for gaseous fuels, comprising a burner body for delivering a fuel gas to a combustion zone which is, in part, defined between two flame-confining walls on respective opposite sides of said zone, the cross-section of said combustion zone, transversely of the direction of gas flow therethrough, being elongate, each said wall being divided in the elongate direction thereof into a plurality of wall elements whose adjacent edges are free to move relatively so as to permit thermal expansion of said elements in said elongate direction, a plurality of brackets mounted on said burner body and extending therefrom in the direction of gas flow, said brackets including slots which slidably receive said edges of the wall elements so as to prevent a significant gasflow between said adjacent edges, said wall elements being rigidly secured to said burner body only at locations on said elements which are upstream of said combustion zone, and cover members which extend between said brackets and define, in conjunction with said brackets and a wall of said burner body, air chambers on opposite sides of said combustion zone, means for supplying air to said to said chambers, and apertures in said flame-confining walls, through which apertures air can flow from said chambers to said combustion zone.

* * * * *